US006053091A

United States Patent [19]

Tojo

[11] Patent Number: 6,053,091

[45] Date of Patent: Apr. 25, 2000

[54] PLUNGER PUMP

[75] Inventor: Nobuo Tojo, Mobara, Japan

[73] Assignee: Maruyama Mfg. Co., Inc., Tokyo, Japan

[21] Appl. No.: 09/090,385

[22] Filed: Jun. 4, 1998

[30] Foreign Application Priority Data

Jun. 5, 1997 [JP] Japan ..... 9-160324
Jul. 29, 1997 [JP] Japan ..... 9-217005

[51] Int. Cl.[7] ..... F01B 3/00

[52] U.S. Cl. ..... 92/71; 417/269; 417/366; 92/153; 92/154

[58] Field of Search ..... 92/12.2, 57, 71, 92/153, 154; 417/269, 366

[56] References Cited

U.S. PATENT DOCUMENTS

| | | | |
|---|---|---|---|
| 4,321,019 | 3/1982 | Degawa et al. | 417/269 |
| 4,544,331 | 10/1985 | Shibuya | 417/269 |
| 5,772,407 | 6/1998 | Kato et al. | 417/269 |
| 5,785,150 | 7/1998 | Tominaga et al. | 92/154 X |
| 5,795,139 | 8/1998 | Ikeda et al. | 417/269 |

FOREIGN PATENT DOCUMENTS

| | | |
|---|---|---|
| 51-44165 | 10/1976 | Japan . |
| 56-15426 | 4/1981 | Japan . |
| 6-17006 | 5/1994 | Japan . |

*Primary Examiner*—Hoang Nguyen
*Attorney, Agent, or Firm*—Pillsbury Madison & Sutro LLP

[57] ABSTRACT

A plunger pump comprising a plunger pump section (34) including a pumping chamber (60), a plunger (36) extending through the pumping chamber, a high pressure side-seal (58) and a low pressure side-seal (56) provided in slide contact with the plunger for preventing leakage of fluid from the pumping chamber, an annular and sealing through which a plunger (36) slidably extends into the pumping chamber (60), and an annular space (62) being defined between the high pressure side-seal (58) and the low pressure side-seal (56) so that it can receive liquid from a suction port (74) for lubrication of the plunger. Even when the plunger pump section (34) is installed at a predetermined or any circumferencial position, air is intended to be vented from the annular space (62). For this purpose, three circumferencially spaced channels (78) are formed in an inner wall of a manifold member (18) surrounding a sleeve (52) defining the pumping chamber (60) and communicate at their ends with the suction port (74) and (62).

9 Claims, 5 Drawing Sheets

PLUNGER PUMP

FIELD OF THE INVENTION

The present invention relates to a plunger pump comprising pumping chamber means sealed by a high pressure side-seal and a low pressure side-seal through which plunger means extend into the pumping chamber means and more particularly, to such a plunger pump including means for introducing liquid through a suction port between the high pressure side- seal and the low pressure side- seal for lubrication of the plunger means.

BACKGROUND OF THE ART

Utility Model Publication Showa 56-15426 and Utility Model Publication Heisei 6-17006 disclose a plunger pump wherein a pumping chamber is sealed by means of a high pressure side- seal and a low pressure side- seal through which a plunger slidably extends into the pumping chamber and liquid is introduced through a suction port into an annular space defined between the high pressure side- seal and the low pressure side- seal for their lubrication.

In the plunger pump disclosed in Utility Model Publication Heisei 6-17006, the annular space communicates with the suction port only at one circumferential position thereof so that when the plunger pump is installed horizontally for a horizontal reciprocation of the plunger and at certain circumferential position, communication between the annular space and the suction port may be made below a lower half of the annular space. This makes it difficult to vent sufficiently the air from the annular space.

In the plunger pump disclosed in Utility Model Publication Showa 56-15426, there are provided two passages space apart circumferentially through 180° for introducing liquid through the suction port into the annular space. Negative pressure due to the Venturi arrangement is required to pass liquid through the passages into the annular space and thus, this is complex in structure.

In the prior plunger pumps, when they are installed at certain circumferential positions about a center axis thereof, liquid leaking through a low pressure side-seal will be collected in the annular space adjacent the low pressure side-seal without any discharge thereof.

Utility Model Publication Heisei 51-44165 discloses a piston pump comprising a piston with a suction valve therein, liquid being suctioned from the proximal end of the piston through a suction valve in the piston into a pumping chamber at the distal end of the piston. A space is provided adjacent to the proximal end of the piston and connected to a suction pipe and a return pipe at positions spaced circumferentially from each other through 180°. Since the space is positioned on the side of the suction port for introducing liquid into the pumping chamber, it is different in nature from the sealed annular space in the plunger pump.

SUMMARY OF THE INVENTION

An object of the present invention is to provide a plunger pump eliminating the above mentioned problems.

This object is achieved, in accordance with the present invention, by providing a plunger pump comprising the following constituents (a) to (e);

(a) a pumping chamber into which liquid is suctioned through a suction port;

(b) a high pressure side-seal located in sliding contact with a plunger at the inner periphery thereof for sealing the pumping chamber;

(c) a low pressure side- seal located in sliding contact with the plunger at the inner periphery thereof and axially spaced apart from the high pressure side-seal;

(d) annular space defined between the high pressure side-seal and the low pressure side- seal with, the plunger extending through the annular space;

(e) a plurality of circumferentially spaced apart channels or passages formed at positions surrounding the pumping chamber for fluid communication between the suction port and the annular space, the passages extending parallel to the longitudinal axis of the plunger.

At least two channels communicate with the annular space at its circumferentially spaced positions. Due to this arrangement of the channels, one of the channels is in fluid communication with the annular space at its higher position even when the horizontal plunger pump has a somewhat circumferentially varied position. Thus, air can be vented from the annular space through one of the channels without trapping air in the annular space.

Where the two channels are in communication with the annular space at positions spaced circumferencially through 180°, at least one channel will be positioned above the center of the annular space even when the plunger pump is installed horizontally at any circumferencial position about the center axis of the plunger pump. This can prevent air from collecting in the lower half of the annular space.

In the plunger pump according to the present invention, at least three channels are preferably provided at different positions circumferentially of the annular space. The three channels may be positioned not at equal angles, such as angles of 100°, 100°, and 160°. In this case, at least one channel will communicate with the annular space at its upper half when the plunger pump is installed horizontally parallel to the center axis of the plunger at any circumferencial position about the center axis of the plunger.

Where three channels are provided around the annular space at equal angles, at least one channel will communicate with each of the upper and lower halves of the annular space at its periphery, even when the horizontal plunger pump is installed at any or predetermined circumferencial position about the center axis of the plunger. Upon introduction of the liquid into the annular space, the liquid can flow from the suction port through the channel into annular space at its lower half while air in the annular space can vent through the channel at the upper half of the annular space.

In the plunger pump according to the present invention, the pumping chamber may be defined by an inner surface of a sleeve inserted in a pump casing member and the channels may be formed in an inner wall of the pump casing member surrounding the inserted sleeve.

In the plunger pump according to the present invention, the pumping chamber may be defined by an inner surface of a sleeve inserted in a pump casing member, and the channels can be formed in outer peripheral surface of the inserted sleeve.

An annular space in the plunger pump, according to the present invention, is defined next to the low pressure side-seal along the longitudinal axis of the plunger, and a plurality of circumferentially spaced discharge passages or slots extend radially outwardly from the annular space so that they can communicate with the atmosphere of the exterior of the pump.

The liquid which has leaked through the low pressure side- seal can be flow into the annular space. Even when the plunger pump is installed horizontally at any circumferential position about the center axis of the plunger, one of the discharge passages will communicate with the annular space at its lower position to discharge the liquid leaking through the low pressure side- seal to the atmosphere.

In the case where two discharge passages are spaced apart circumferentially through 180°, at least one of the discharge passages will be positioned below the center of the annular space when the plunger pump is installed horizontally at any circumferential position. This allows discharge of the leaked liquid from the upper half of the annular space.

The plunger pump according to the present invention may have three discharge passages provided at positions spaced a circumferentially about the annular space. Even through the three discharge passages are not arranged circumferentially of the annular space at equal angles (such as 100°, 100°, 160°) it is ensured that at least one discharge passage extend downwardly of the annular space when the horizontal plunger pump is at a circumferential position about the center axis of the plunger.

The plunger pump may be of a multi plunger type comprising an input; previously described shaft to which a rotative power is input, plunger pump sections, arranged around the longitudinal axis of the input shaft at equal angles and each including a pumping chamber extending parallel to the longitudinal axis of the input shaft; a suction port and a discharge port common to the pumping chambers; a plunger in each of the pumping chambers for axial reciprocation; and a swash plate mounted on the input shaft in an inclined relation to the longitudinal axis of the input shaft for axially reciprocating the plungers in the pumping chambers as it is rotated with the input shaft.

PREFERRED EMBODIMENT OF THE INVENTION

Figure 1:
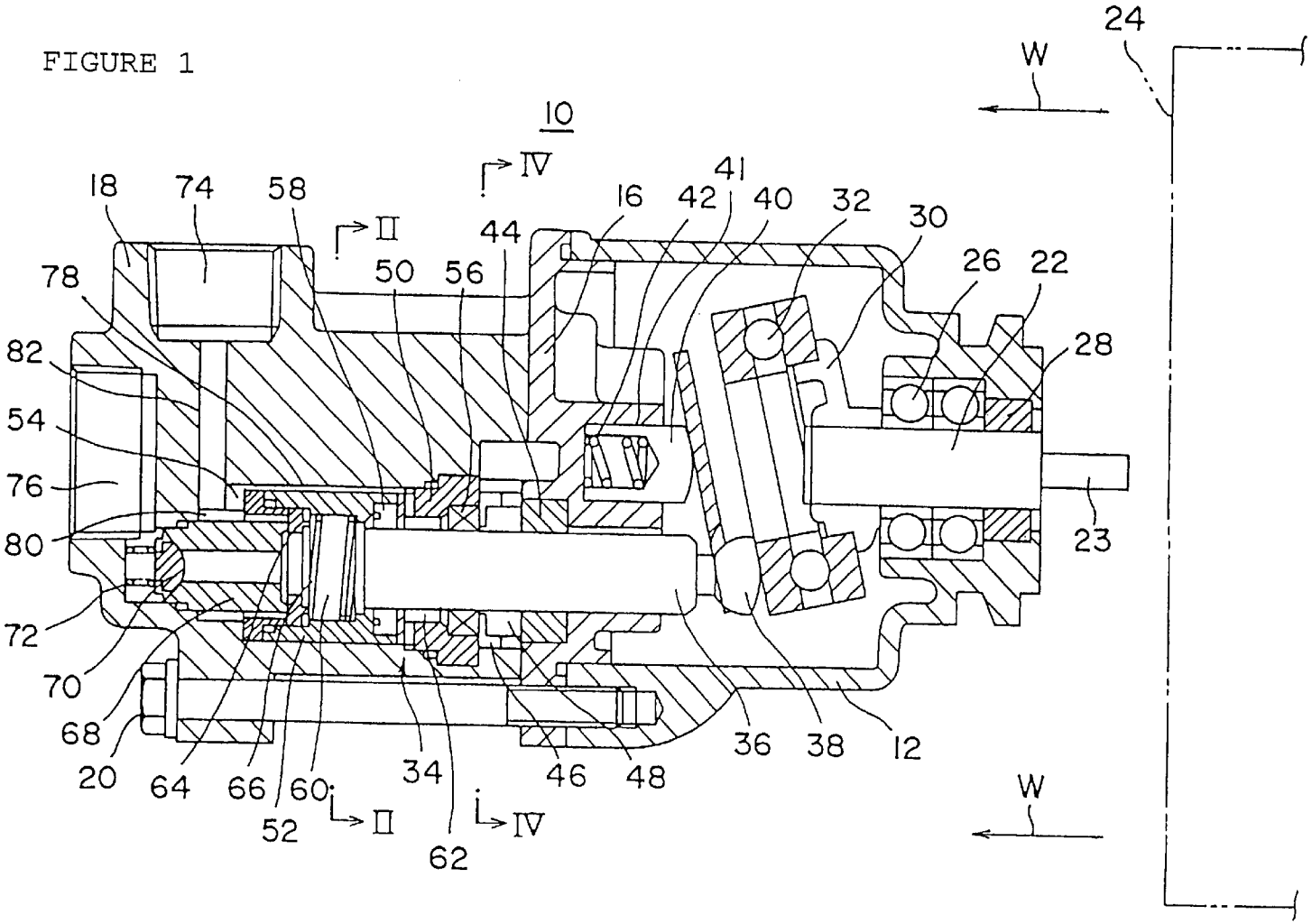
FIG. 1 is a vertical section view of the triple plunger pump according to the present invention.

FIG. 1 of the drawings shows a triple plunger pump 10 comprising a casing 12, a partition member 16, and a manifold member 18 each disposed horizontally Three clamping bolts 20 extends through the manifold member 18 and partition member 16 and is threaded into the casing 12 to clamp them horizontally. Pump input shaft 20 is rotatably mounted in the casing 12 via ball bearings 26 and has an external portion thereof 23 adapted to be connected to an output shaft of a drive motor 24. The motor 24 contains therein a cooling fan (not shown) to flow cooling air around the periphery of the triple plunger pump in a direction parallel to an axis of the pump input shaft 24 as indicated by arrows W in FIG. 1, during operation of the motor 24. The flow of cooling air may be reversed as opposed to direction W. Oil seal 28 is mounted in a rear wall of the casing 12 around the pump input shaft 22 to prevent any leakage of lubricant oil within the casing 12. A swash plate 30 is secured to the pump input shaft 22 at its tip at a predetermined angle to the longitudinal axis of the pump input shaft 22 and provided with a thrust bearing 32 attached thereto. Three plunger pump sections 34 are arranged horizontally around the longitudinal axis of the pump input shaft 22 in a relation spaced apart through 120° from each other. Each of the plunger pump sections includes a plunger 36 having an enlarged portion 38 at its one end. Pusher member 40 is slidably received in a center bore 41 formed in the partition member 16 and urged toward the swash plate 30 by means of a compression coil spring 42 to push the enlarged portions 38 of the plunger members 36 against the thrust bearing 32 . For each plunger pump section, oil seal 44 is disposed in a recess formed in the partition member 16 on its side facing the manifold 18 to sealingly engage the plunger member 36, thereby preventing any leakage of oil within the casing 12. Seal gland 46 abuts each of the oil seals 44 to prevent it from coming off. Each seal gland 46 also cooperates with the plunger member 36 to define an annular space 48 for receiving leaked fluid. There are provided a seal casing 50, a sleeve 52 and a cylindrical collar 54 arranged axially of each of the plunger member 36 and inserted in the manifold 18 around the plunger member. Low pressure side seal 56 is received in a recess formed in each of the seal casing 50 facing the seal gland 46 and sealingly engages the plunger member 36 at the inner periphery thereof. High pressure side seal 58 is received in a recess formed in each of the sleeve 52 and sealingly engage the plunger member 36 at the inner periphery thereof. Each of the sleeves 52 defines a pumping chamber 60, a volume of which is increased and decreased by the reciprocating plunger member 36. Annular space 62 is defined in each of the seal casing 50 between the seals 56 and 58. An annular suction valve 64 with a center opening is inserted in each of the sleeve 52 from the side of the collar 54 and pushed against the latter by means of a compression coil spring 66 disposed within the pumping chamber. A valve seat member 68 has a center opening in communication with the center opening of the annular suction valve 64 and is coaxially positioned within the collar 54 to define an annular gap between the valve seat member 68 and the collar 54 for flow of fluid. When the suction valve 64 seats on the end face of the valve seat member, it can close the annular gap. A discharge valve 70 is resiliently seated on the valve seat member 68 at the end face opposite to the suction valve 64, by means of a compression spring 72 to close the central opening of the valve seat.

Suction port 74 and discharge port 76 are formed in the manifold 18 at its top and forward end, respectively, to be integral with to the three plunger pump sections 34. An annular space 80 is formed in the manifold member 18 around the outer periphery of the valve seat member 68 of each of the plunger pump sections 34 and communicates through a suction passage 82 with the suction port 74. When each suction valve 64 is in its opened position, the pumping chamber 60 communicates with the annular space 80 through the annular gap between the cylindrical collar 54 and the valve seat 68. Each pumping chamber 60 communicates with the discharge port 76 through the central openings in the suction valve 64 and the valve seat 68 when the discharge valve 70 is in its opened position.

Figure 2:
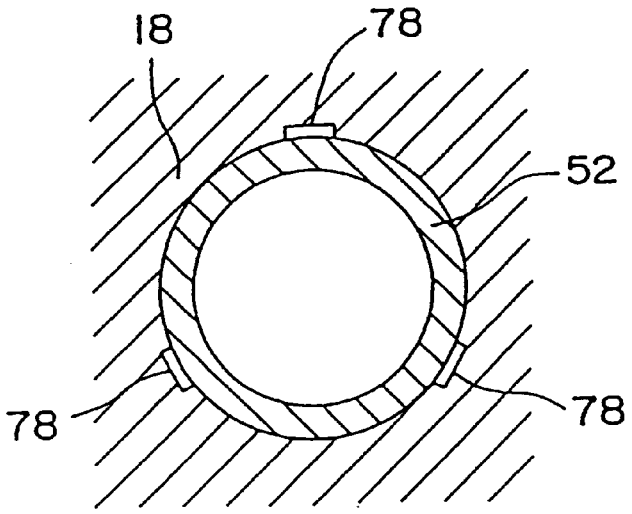
FIG. 2 is a view of cross section taken along line II—II of FIG. 1.

FIG. 2 is a view in section taken along line II—II of FIG. 1. As can be seen in FIGS. 1 and 2, three channels 78 are formed in the manifold member 18 around the sleeve 52 defining the pumping chamber 60, in a relation spaced apart from each other at 120° and extend parallel to the longitudinal axis of the plunger member 36. Each of the channels 78 is positioned radially outwardly of the annular space 64 and communicates at its one end with the latter and is at opposite end with respect to the annular space 80 which is in fluid communication with the suction passage 82.

Figure 3:
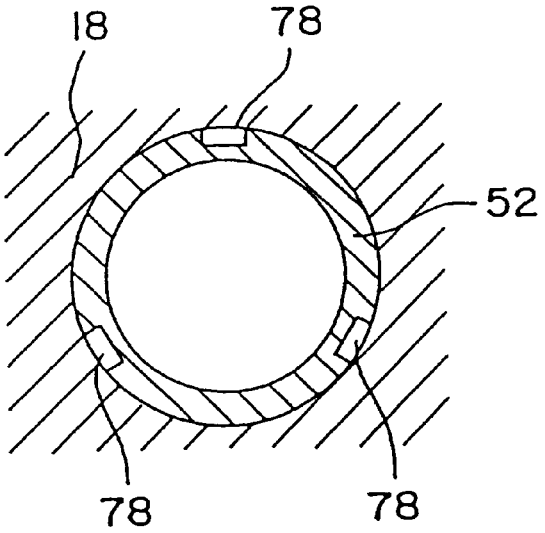
FIG. 3 is a view similar to FIG. 2 but illustrating an alternative embodiment of the channels.

FIG. 3 shows an alternative embodiment of forming channels 78. The channels 78 shown in FIG. 3 are different from those shown in FIG. 1 in that they are formed in sleeve 52 on its outer periphery.

Figure 4:
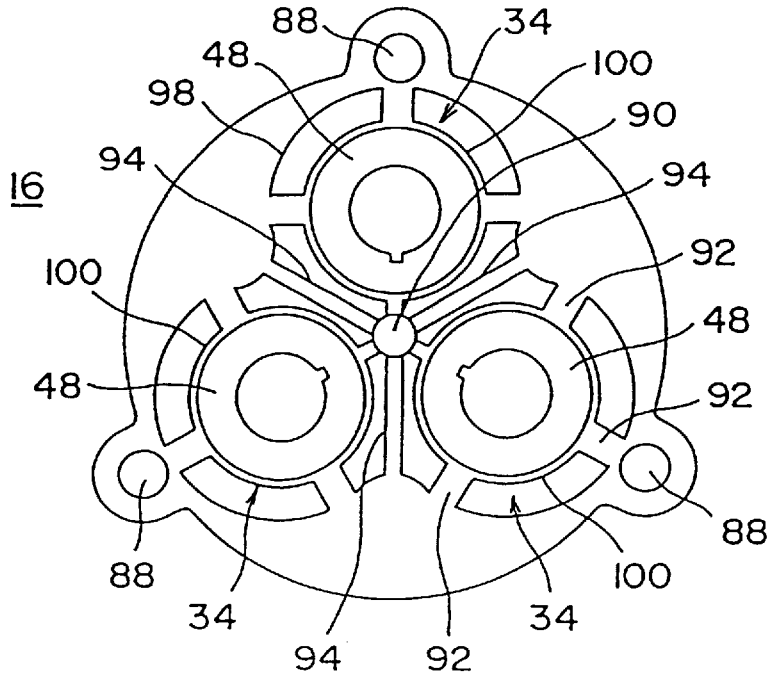
FIG. 4 is a view of the partition member in cross section taken along line IV—IV of FIG. 1.
Figure 5:
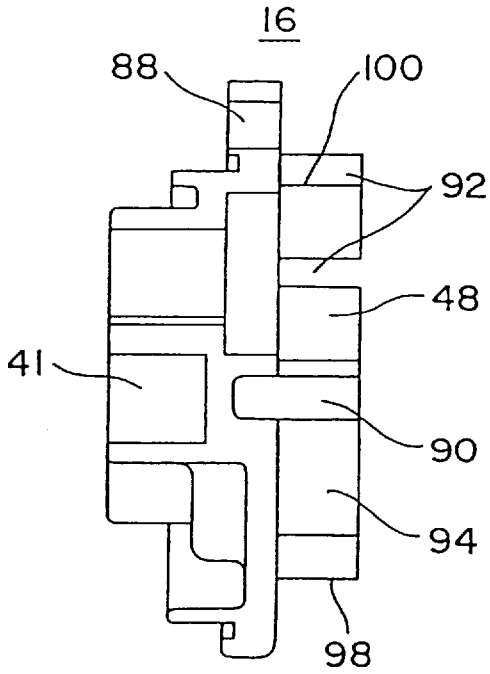
FIG. 5 is a cross section view of the partition member taken along line IV—IV of FIG. 4.

FIG. 4 shows a cross section of the partition member 16 taken along line IV—IV of FIG. 1 while FIG. 5 shows a cross section of the partition member taken along line V—V of FIG. 4. Through holes 88 are formed in flanges of the partition member 16 adjacent to the periphery thereof for passage of the clamping bolts 20 (shown in FIG. 1). The partition member 16 is provided with three sets of wall segments protruding therefrom to form three circular bores 100 which are spaced circumferentially about the center of the partition member at 120° and through which the plunger members 36 in the plunger pump sections 34 extend. The annular space 48 in each plunger pump section 34 as described previously is defined by the circular bore 100. A plurality of slots 92 are defined between the adjacent wall segments 98 in each and extend radially outwardly of the annular space 48. The slots 92 may be spaced circumferentially through 90°. There are also provided three slots 94 each defined between the adjacent wall sections in the adjacent sets of the wall segments and extending radially outwardly from a center aperture 90 formed in the partition member 16 to communicate with the slots 92 adjacent to the center of the partition member 16. Thus, the annular space 48 communicates through the slots 92 and 94 with the atmosphere.

In operation, motor 24 is actuated to rotate the pump input shaft 22, rotating the swash plate 30 while maintaining the angle set relative to the longitudinal axis of the pump. The plunger member 36 in each plunger pump section 34 is reciprocated by the thrust bearing 32 on the rotating swash plate 30, with the enlarged portion 38 pushed against the thrust bearing 32 by the pusher member 40. This results in increase and decrease in volume of the pumping chambers 60. As the pumping chambers 60 have the increased volume at the suction stroke of the plunger pump, pressure in each of the pumping chambers is decreased so that the discharge valve 70 will be seated on the valve seat member 68. At the same time, the annular suction valve 64 will be disengaged from the valve seat 68 against the action of the compression coil spring 66 to permit flow of fluid (e.g. water) through the suction passage 82, annular space 80, annular gap defined between the inner peripheral surface of the collar 54 and the outer peripheral surface of the valve seat member 68 into the pumping chamber 60 under the action of suction. At the discharge stroke of the plunger pump, decrease in volume of each pumping chamber 8 causes pressure in the pumping chamber to be increased, thereby bringing the suction valve 64 into contact with the valve seat member 68 for closing the annular gap. Each of the discharge valve 70 is disengaged from the valve seat member 68 against the action of the compression coil spring 72 to discharge the fluid from the pumping chamber 60 through the center opening in the valve seat member 68 and the discharge port 76.

Due to the fact that the annular space 80 in each of the plunger pump sections is in communication with the annular space 62 in the seal casing 50 through the three channels 78, fluid from the suction port 74 can flow into the annular space 62. At any desired positions of the triple plunger pump about its longitudinal axis, at least one of the channels is located adjacent to the upper half of the annular space 62 and at least one of the remaining channels is located adjacent to the lower half of the annular space 62. Consequently, the fluid can smoothly flow through the lower channel 78 into the annular space 62 while venting air from the annular space through the upper channel 78. Thus, the arrangement of the three channels spaced apart circumferentially at 120° is effective in preventing air from remaining in the annular space 62. The fluid which is in contact with the portion of the plunger member 36 within the annular space 62, serves as lubricant required for smooth slide of the plunger relative to the low pressure side and high pressure side- seals 56 and 58. Some of the fluid could leak through the high pressure side-seals 58 into the annular spaces 62, but combination of the leaked fluid and fluid flowing through the channels 78 into the annular space 62 would prevent further leakage of fluid.

A portion of the fluid in the annular space 62 can leak through the low pressure side-seals 56 into the annular spaces 48 for collection, each of which is in communication with atmosphere through the slots 92 and 94. Consequently, at any desired positions of the horizontal triple plunger pump about the longitudinal axis of the pump input shaft 22, at least one of the slots 92 and 94 located at the upper half of each of the annular space 48 permits flow of air thereinto while the leaked fluid in the annular space 48 is drained through the slots 92 or 94 located at the lower half thereof, into the exterior of the pump.

The cooling fan which is rotatively driven by the motor 24, produces flow of cooling air along the periphery of the pump as indicated by W to reduce pressure around the pump so that the suction causes air to be sucked out of the annular space 48, thereby cooling the partition member 16. Thus, this results in restriction of heat transfer.

Figure 6:
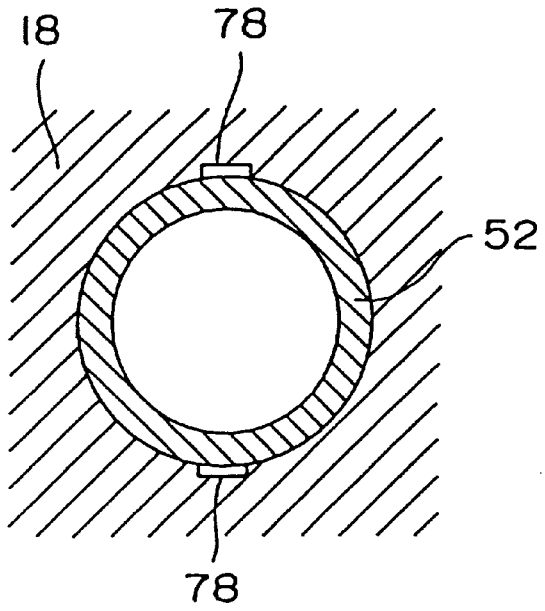
FIG. 6 is a view illustrating another alternative embodiment of the channels as shown in FIG. 2.
Figure 7:
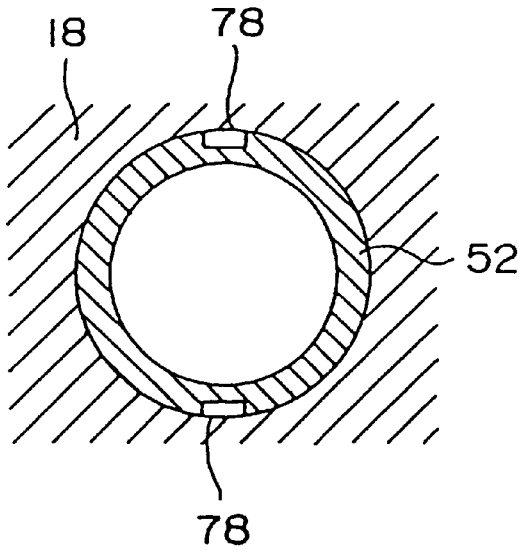
FIG. 7 is a view illustrating an alternative embodiment of the partition member as shown in FIG. 3.

FIGS. 6 and 7 correspond to the cross-section views of FIGS. 2 and 3 but show a alternate embodiments of the manifold member and sleeve of the pump. In FIGS. 6 and 7, channels 78 are spaced apart around the pumping chamber 60 at 180° and formed in the manifold member 18 or in the sleeve 52 on its outer periphery. Even when the horizontal triple plunger pump is at any positions about the longitudinal axis of the input shaft 22 thereof, one of the channels 78 is appropriately positioned above the annular space 62 for fluid communication therewith to allow bleeding of air from the annular space 62 through the channel 78. Liquid leaking into the annular space 62 comes into contact with the periphery of the plunger 36 and serves as lubricant for facilitating slide of the plunger 36 relative to the low pressure side-seal 56 and the high pressure side- seal 58. A portion of the liquid from the each of the pumping chamber 60 can leak through the high pressure side- seal 58 into the annular space 62 where it will be mixed with liquid through the channels 78 for restriction of further leakage.

Figure 8:
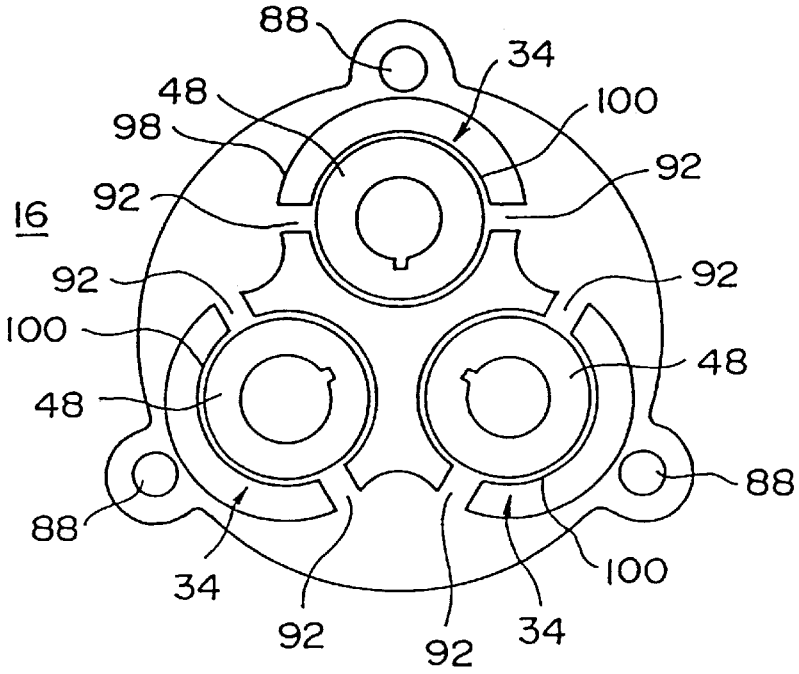
FIG. 8 is a view illustrating an alternative embodiment of the partition member as shown in FIG. 4.

FIG. 8 shows an alternative embodiment of the partition member shown FIG. 4. In each of the plunger pump section, there are not provided any slots 94, and only two slots extend radially outwardly of the center of the partition member 16. In FIG. 8, the slots 92 in each plunger pump section 34 are spaced apart at 180° but may be positioned at an angle other than 180°. When the horizontal triple plunger pump is at a predetermined position or any positions about the longitudinal axis of the input shaft 22 thereof, the slots 92 are appropriately positioned below the annular space 48 so that leaked liquid in the annular space 48 will be discharged into the atmosphere without any accumulation thereof.

What I claim:

1. A plunger pump comprising:

(a) a pumping chamber into which liquid is suctioned through a suction port;

(b) a high pressure side-seal having an inner periphery in sliding contact with a plunger having a longitudinal axis for sealing the pumping chamber; and (c) a low pressure side-seal having an inner periphery in sliding contact with the plunger and spaced apart axially from the high pressure side-seal, the high pressure side-seal and the low pressure side-seal defining therebetween a first annular space through which the plunger extends;

wherein the pumping chamber is surrounded by a plurality of circumferentially spaced apart channels for permitting fluid communication between the suction port and the first annular space, wherein the plunger pump has a second annular space formed therein next to the low pressure side-seal along the longitudinal axis of the plunger, wherein a plurality of circumferentially spaced discharge passages extends radially outwardly from the second annular space to permit the discharge passages to communicate with the atmosphere exterior to the pump, wherein the channels extend parallel to the longitudinal axis of the plunger, and wherein at least three of the channels are provided at different positions circumferentially around the first or second annular space.

2. The plunger pump as defined in claim 1 wherein the pumping chamber is defined by an inner surface of a sleeve inserted in a pump casing member and the channels are formed in an inner wall of the pump casing member surrounding the inserted sleeve.

3. The plunger pump as defined in claim 1 wherein the pumping chamber is defined by an inner surface of a sleeve inserted in a pump casing member and the channels are formed in an outer peripheral surface of the inserted sleeve.

4. The plunger pump as defined in claim 1 wherein the three discharge passages are arranged at positions spaced circumferentially of the second annular space.

5. A multi-plunger pump comprising an input shaft with a longitudinal axis to which a rotative power is input, plunger pump sections as defined in claim 1 arranged around the longitudinal axis of the input shaft at equal angles and each including a pumping chamber extending parallel to the longitudinal axis of the input shaft, a suction port and a discharge port common to the pumping chambers, a plunger in each of the pumping chambers for axial reciprocation, and a swash plate mounted on the input shaft in an inclined relation to the longitudinal axis of the input shaft for reciprocating axially the plungers in the pumping chambers as the swash plate is rotated with the input shaft.

6. A plunger pump comprising:

a pumping chamber into which liquid is sucked through a suction port;

a high pressure side-seal located in sliding contact with a plunger at the inner periphery thereof for sealing the pumping chamber;

a low pressure side-seal located in sliding contact with the plunger at the inner periphery thereof and spaced apart axially from the high pressure side-seal;

annular space defined between the high pressure side-seal and the low pressure side-seal, the plunger extending through the annular space; and a plurality of circumferencially spaced apart channels or passages formed at positions surrounding the pumping chamber for fluid communication between the suction port and the annular space, the passages extending parallel to the longitudinal axis of the plunger, wherein the pumping chamber is defined by an inner surface of a sleeve inserted in a pump casing member and the channels are formed in an outer peripheral surface of the inserted sleeve.

7. A plunger pump comprising:

a pumping chamber into which liquid is sucked through a suction port;

a high pressure side-seal located in sliding contact with a plunger at the inner periphery thereof for sealing the pumping chamber;

a low pressure side-seal located in sliding contact with the plunger at the inner periphery thereof and spaced apart axially from the high pressure side-seal;

annular space defined between the high pressure side-seal and the low pressure side-seal, the plunger extending through the annular space; and a plurality of circumferencially spaced apart channels or passages formed at positions surrounding the pumping chamber for fluid communication between the suction port and the annular space, the passages extending parallel to the longitudinal axis of the plunger, wherein at least three channels are preferably provided at different positions circumferentially of the annular space, and wherein the pumping chamber is defined by an inner surface of a sleeve inserted in a pump casing member and the channels are formed in an outer peripheral surface of the inserted sleeve.

8. A plunger pump comprising:

a pumping chamber into which liquid is sucked through a suction port;

a high pressure side-seal located in sliding contact with a plunger at the inner periphery thereof for sealing the pumping chamber;

a low pressure side-seal located in sliding contact with the plunger at the inner periphery thereof and spaced apart axially from the high pressure side-seal;

annular space defined between the high pressure side-seal and the low pressure side-seal, the plunger extending through the annular space; and a plurality of circumferencially spaced apart channels or passages formed at positions surrounding the pumping chamber for fluid communication between the suction port and the annular space, the passages extending parallel to the longitudinal axis of the plunger, wherein an annular space is formed in the plunger pump next to the low pressure side-seal along the longitudinal axis of the plunger, and a plurality of circumferencially spaced discharge passages or slots extend radially outwardly from the annular space so that they can communicate with the atmosphere of the exterior of the pump.

9. A plunger pump comprising:

a pumping chamber into which liquid is sucked through a suction port;

a high pressure side-seal located in sliding contact with a plunger at the inner periphery thereof for sealing the pumping chamber;

a low pressure side-seal located in sliding contact with the plunger at the inner periphery thereof and spaced apart axially from the high pressure side-seal;

annular space defined between the high pressure side-seal and the low pressure side-seal, the plunger extending through the annular space; and a plurality of circumferencially spaced apart channels or passages formed at positions surrounding the pumping chamber for fluid communication between the suction port and the annular space, the passages extending parallel to the longitudinal axis of the plunger, wherein at least three channels are preferably provided at different positions circumferentially of the annular space, and wherein an annular space is formed in the plunger pump next to the low pressure side-seal along the longitudinal axis of the plunger, and a plurality of circumferencially spaced discharge passages or slots extend radially outwardly from the annular space so that they can communicate with the atmosphere of the exterior of the pump.

* * * * *

UNITED STATES PATENT AND TRADEMARK OFFICE

CERTIFICATE OF CORRECTION

PATENT NO. : 6,053,091

DATED : April 25, 2000

INVENTOR(S) : TOJO

It is certified that error appears in the above-indentified patent and that said Letters Patent is hereby corrected as shown below:

ON THE TITLE PAGE

Item [30] Foreign Application Priority Data, please change

"Jun. 5, 1997 [JP] Japan. . . . . .9-160324"

to

--Jun. 5, 1997 [JP] Japan. . . . . .9-162034--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*